US005839767A

United States Patent [19]

Piltingsrud

[11] Patent Number: 5,839,767

[45] Date of Patent: Nov. 24, 1998

[54] PICK-RESISTANT LOCK ACTUATOR

[75] Inventor: Stephen M. Piltingsrud, Owatonna, Minn.

[73] Assignee: Truth Hardware Corporation, Owatonna, Minn.

[21] Appl. No.: 812,599

[22] Filed: Mar. 7, 1997

[51] Int. Cl.[6] ..... E05B 3/00

[52] U.S. Cl. ..... 292/336.3; 292/158; 292/161

[58] Field of Search ..... 292/158, 161, 292/336.3

[56] References Cited

U.S. PATENT DOCUMENTS

| | | | |
|---|---|---|---|
| 51,222 | 11/1865 | Ridell . | |
| 352,617 | 11/1886 | Ives | 292/112 |
| 369,146 | 8/1887 | Woll | 292/199 |
| 2,538,385 | 1/1951 | Schurman | 292/DIG. 20 |
| 4,059,298 | 11/1977 | Van Klompenburg . | |
| 4,621,847 | 11/1986 | Paulson et al. | 292/199 |
| 4,932,694 | 6/1990 | Cater . | |
| 4,982,303 | 1/1991 | Krenz . | |
| 4,991,886 | 2/1991 | Nolte et al. . | |
| 5,087,087 | 2/1992 | Vetter et al. . | |
| 5,090,750 | 2/1992 | Lindqvist . | |
| 5,118,145 | 6/1992 | Tucker . | |
| 5,152,103 | 10/1992 | Tucker et al. . | |
| 5,219,193 | 6/1993 | Piltingsrud . | |
| 5,448,857 | 9/1995 | Stormo . | |

FOREIGN PATENT DOCUMENTS

| | | | |
|---|---|---|---|
| 626330 | 2/1936 | Germany | 292/161 |

OTHER PUBLICATIONS

Truth Brochure: "Multi–Point Locking System", pp. 2.8–2.8g (1996).

Truth Brochure: "Casement and Awning Sash Locks" (1996).

*Primary Examiner*—Steven Meyers
*Assistant Examiner*—Tuyet-Phuong Pham
*Attorney, Agent, or Firm*—Wood,Phillips, VanSanten, Clark & Mortimer

[57] ABSTRACT

An actuator for a window lock including a housing mountable to a window frame and defining an opening between opposite sides, one of the sides having a recessed portion therein. A handle is pivotable about an axis within the housing opening and has a central opening with sloped cam surfaces therearound. A cam bushing is receivable in the handle central opening and has sloped cam surfaces engageable with the handle cam surfaces whereby pivoting of the handle relative to the cam bushing axially biases the cam bushing relative to the handle toward a locking position. The cam bushing further includes a stop tab extending from one side of the cam bushing and receivable in the housing recessed stop when the actuator is in a locking position. The cam bushing one side is axially biased toward the housing one side. A lock link is operatively connectable to a window lock for operating a lock in response to pivoting of the lock link, and is pivotally connected to the cam bushing.

35 Claims, 3 Drawing Sheets

FIG. 1
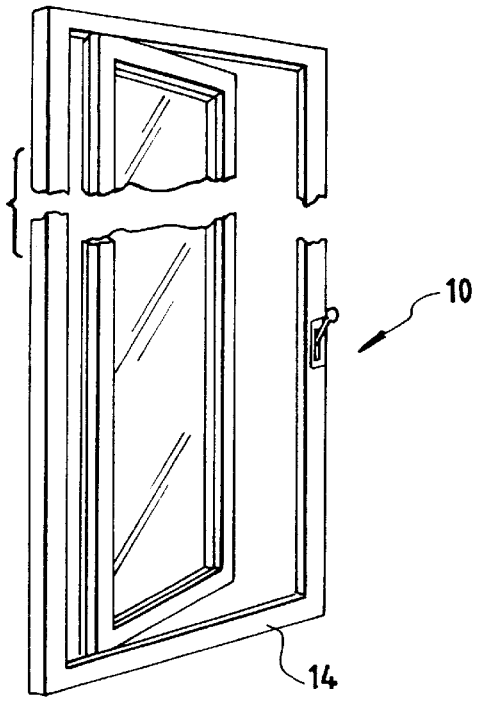
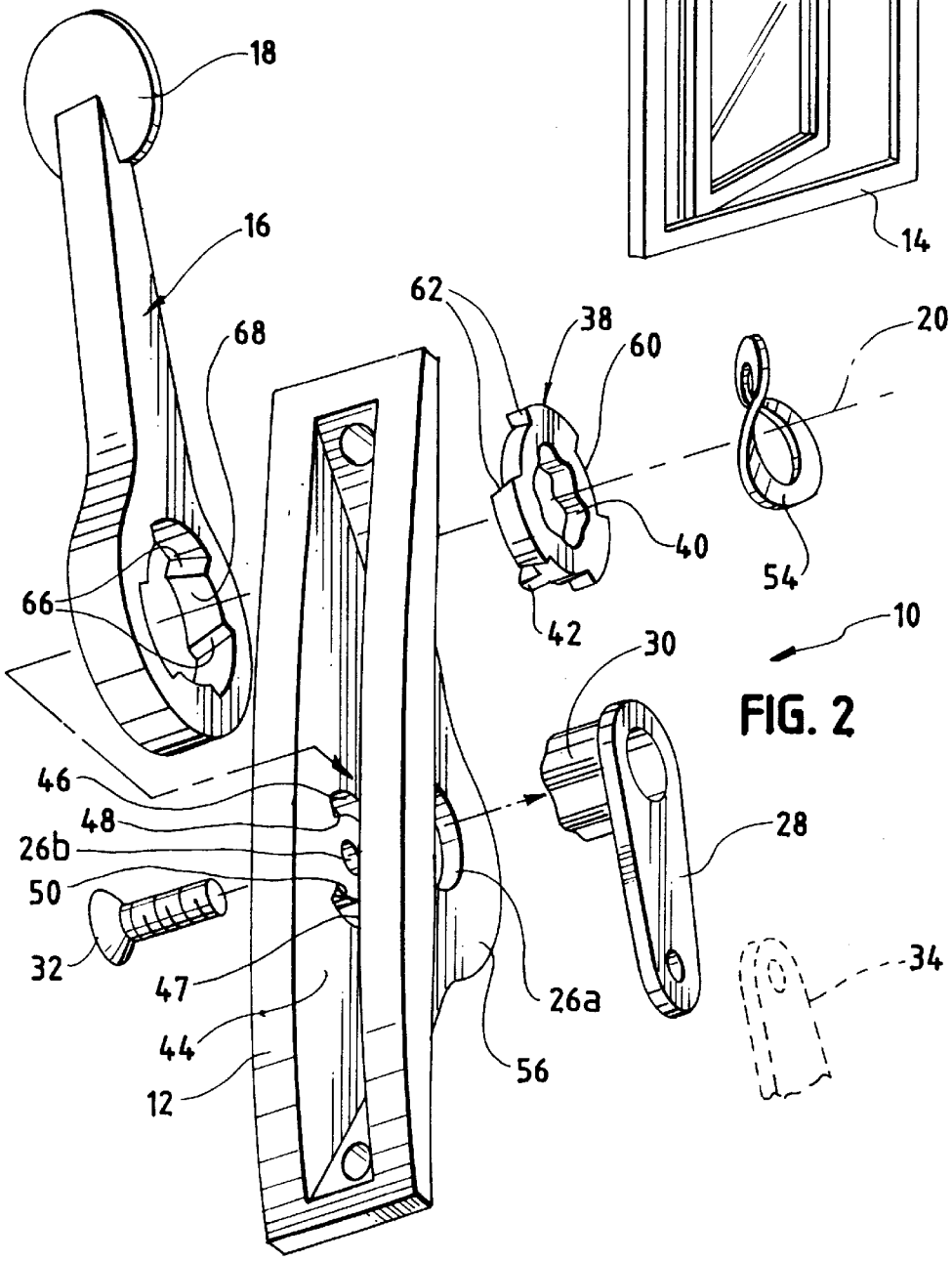
FIG. 2

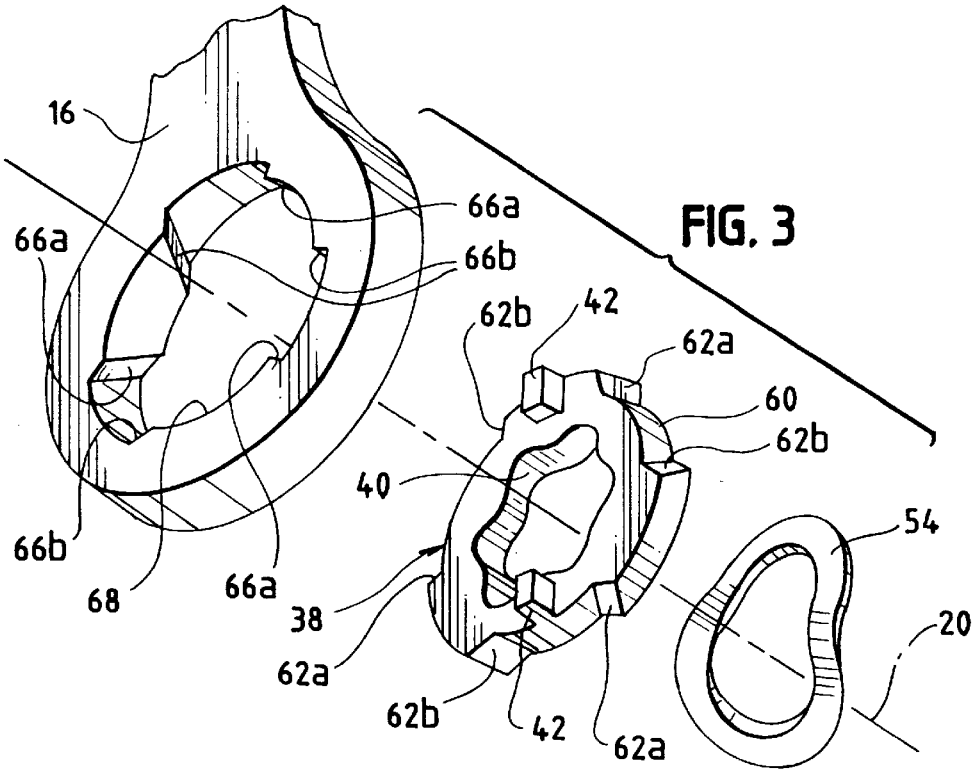
FIG. 3
FIG. 4
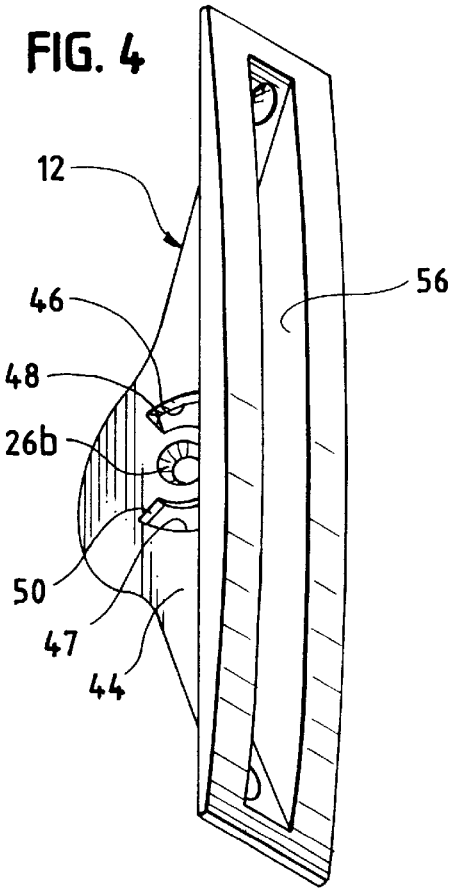
FIG. 5
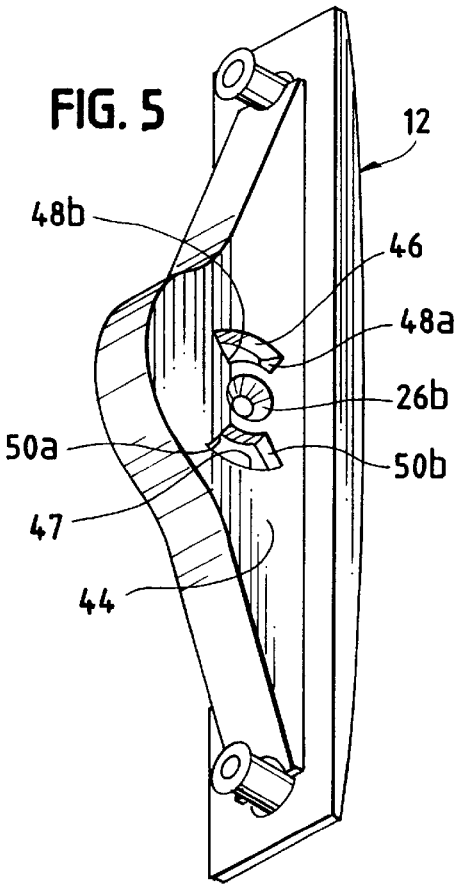

PICK-RESISTANT LOCK ACTUATOR

BACKGROUND OF THE INVENTION

1. Technical Field

This invention relates to window locks and more particularly toward actuators for pick-resistant locking systems for casement and awning windows.

2. Background Art

Casement and awning windows include window sashes secured by hinges to opposite sides of a window frame (generally, casement windows have hinges on the top and bottom and awning windows have hinges on the sides). Such window typically include locks mounted on the window frame opposite the hinges, and cooperate with complementary locking means on the adjacent portion of the window sash. Typically, particularly with larger windows requiring locking at multiple locations along the side of the sash (multi-point locking), the lock includes a housing mounted on the window frame and pivotally supporting a handle which controls a link connected to one or more catches (typically rollers) to move the catches in and out of engagement with the locking means (typically cam members) on the sash for locking and unlocking respectively.

A constant concern with the windows, and particularly window locks, is obviously security. The locks are obviously intended to provide security against illegal intrusion into the building. Therefore, it is important that the locks not only securely hold the window sash closed when desired, but it is also important that a potential intruder outside the building not be able to manipulate or pick the lock so as to open it from the outside to enable the person to then actually intrude into the building through the window.

In multi-point locks, for example, there is a tie bar which extends along one side of the window frame and ties together the multiple catches. There is, therefore, a danger that a potential intruder might be able to gain access to and manipulate the tie bar to move all of the catches to unlocked positions, thereby enabling the intruder to freely open the window and gain unauthorized access.

Further, such locking structures are often necessarily prominently placed on a window frame so that they can be properly used, but in such case it is sometimes difficult to keep the locking structure from intruding improperly on the aesthetic appearance of the overall window. Increasingly in today's home construction in particular, the overall aesthetics of the window are primary design elements, and therefore locking structures which intrude upon or detract from that are particularly undesirable.

The present invention is directed toward overcoming one or more of the problems set forth above.

SUMMARY OF THE INVENTION

In one aspect of the present invention, an actuator for a window lock is provided, including a drive member secured for pivoting about an axis, a pivotable lock link having a radial portion operatively connectable to a window lock for operating a lock in response to pivoting of the lock link, structure for securing the lock link and drive member for pivoting together when a pivoting force is applied to the drive member, and structure for restraining the lock link against pivoting when pivoting forces are applied to the lock link radial portion.

In a preferred form of this aspect of the present invention, a pivot link is substantially secured for pivoting with the lock link and the drive member and has a stop member which in a first position is secured against pivoting and in a second position freely pivots about the axis. Structure is provided for biasing the pivot link toward the first position, and for biasing the pivot link toward the second position when a pivoting force is applied to the drive member.

In another preferred form of this aspect of the present invention, the pivot link moves axially between the first and second positions, and engaging sloped cam surfaces on the pivot link and the drive member bias the pivot link toward the second position when the drive member is pivoted. In one preferred form of this aspect of the present invention, the pivot link is a bushing which is axially movable relative to the drive member and the lock link.

In yet another preferred form of this aspect of the present invention, a housing receives the pivot link and one end of the drive member for pivoting about the axis between opposite sides of the housing, and a stop surface on one side of the housing and a stop surface on the pivot link axially overlap when the pivot link is in the first position. In one preferred form of this aspect of the present invention, the housing opposite sides are spaced apart a distance less than the combined axial thicknesses of the pivot link and the one end of the drive member.

In still another preferred form of this aspect of the present invention, the bushing has an axially extending non-cylindrical central opening and an axially extending non-cylindrical outer surface, and the bushing is received in an opening in the drive member with the bushing outer surface cooperating with the drive member opening to substantially pivot the bushing and the drive member together. In this preferred form, the lock link includes an axial shaft received in the bushing central opening and cooperating with the bushing central opening to allow axial movement of the bushing relative to the lock link while securing the lock link and bushing for pivoting together about the axis.

In another aspect of the present invention, an actuator for a lock is provided, including a fixed member defining a pivot axis and having a stop surface at least in part extending axially and radially relative to the pivot axis. A lock link is secured to the fixed member for pivoting about the pivot axis and is operatively connectable to a window lock for operating a lock in response to pivoting of the lock link. A stop link is secured for pivoting with the lock link and is axially movable with a stop member axially aligned with the fixed member stop surface in a securing position and axially spaced from the fixed member stop surface in an operating position. The stop link is axially biased toward the securing position, A drive member is pivotable about the pivot axis, and is drivably connected for pivoting with the stop link. The stop link is biased toward the operating position in response to a drive force applied to the drive member.

In a preferred form of this aspect of the present invention, engaging sloped cam surfaces on the stop link and the drive member bias the stop link toward the operating position.

In another preferred form of this aspect of the present invention, the fixed member includes a recess with the fixed member stop surface comprising one side of the recess, and the stop link stop member projects outwardly from one side of the stop link and into the fixed member recess when the stop link is in the securing position.

In still another preferred form of this aspect of the present invention, the fixed member is a housing fixable to a window frame and having an interior with the drive member and stop link pivotable in the interior, the stop surface being on one side of the housing interior with the stop link biased toward the one housing side. In one preferred form of this aspect of the present invention, the housing interior has the one side and an opposite, substantially parallel side, both housing sides being substantially perpendicular to the pivot axis, and the housing one side and housing other side being spaced apart a distance less than the combined axial thicknesses of the stop link and the drive member in the housing interior.

In yet another preferred form of this aspect of the present invention, the stop link is a bushing which is axially movable relative to the drive member. The bushing has an axially extending non-cylindrical central opening and an axially extending non-cylindrical outer surface, and the bushing is received in an opening in the drive member with the bushing outer surface cooperating with the drive member opening to substantially pivot the bushing and the drive member together. In this preferred form, the lock link includes an axial shaft received in the bushing central opening and cooperating with the bushing central opening to allow axial movement of the bushing relative to the lock link while securing the lock link and bushing for pivoting together about the axis.

In still another aspect of the present invention, an actuator for a window lock is provided including a housing mountable to a window frame and defining an opening between opposite sides, one of the sides having a recessed portion therein. A handle is pivotable about an axis within the housing opening and has a central opening with sloped cam surfaces therearound. A cam bushing is receivable in the handle central opening and has sloped cam surfaces engageable with the handle cam surfaces whereby pivoting of the handle relative to the cam bushing axially moves the cam bushing relative to the handle. The cam bushing further includes a stop tab extending from one side of the cam bushing and receivable in the housing recessed portion when the actuator is in a locking position. The cam bushing one side is axially biased toward the housing one side. A lock link is operatively connectable to a window lock for operating a lock in response to pivoting of the lock link, the lock link further being pivotally connected to the cam bushing.

It is an object of the invention to provide a secure and pick resistant locking structure for windows.

It is another object of the invention to provide a window locking structure which is easy and inexpensive to install, and which may be readily used on a wide variety of current and old window structures.

It is still another object of the invention to provide a window locking structure which is easy to use.

It is yet another object of the present invention to provide a window locking structure which minimizes the intrusion of the structure on the overall aesthetics of the window.

BRIEF DESCRIPTION OF THE DRAWINGS

FIG. 1 is a perspective view of a preferred embodiment of the invention as used with a window frame and sash;

FIG. 2 is an exploded perspective view of the lock actuator of FIG. 1;

FIG. 3 is an exploded perspective partial view lock actuator of FIG. 1;

FIGS. 4–5 are perspective views of the housing of the lock actuator of FIG. 1;

DETAILED DESCRIPTION OF THE PREFERRED EMBODIMENT

Figure 6:
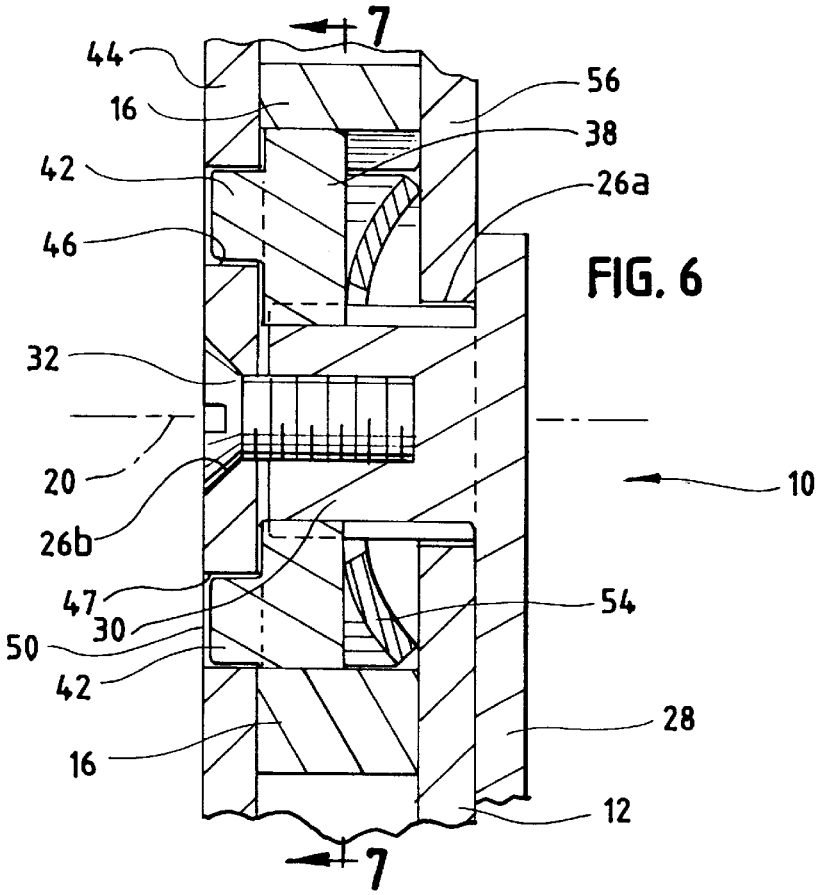
FIG. 6 is a partial cross-sectional view through the pivot axis of the lock actuator of FIG. 1.
Figure 7:
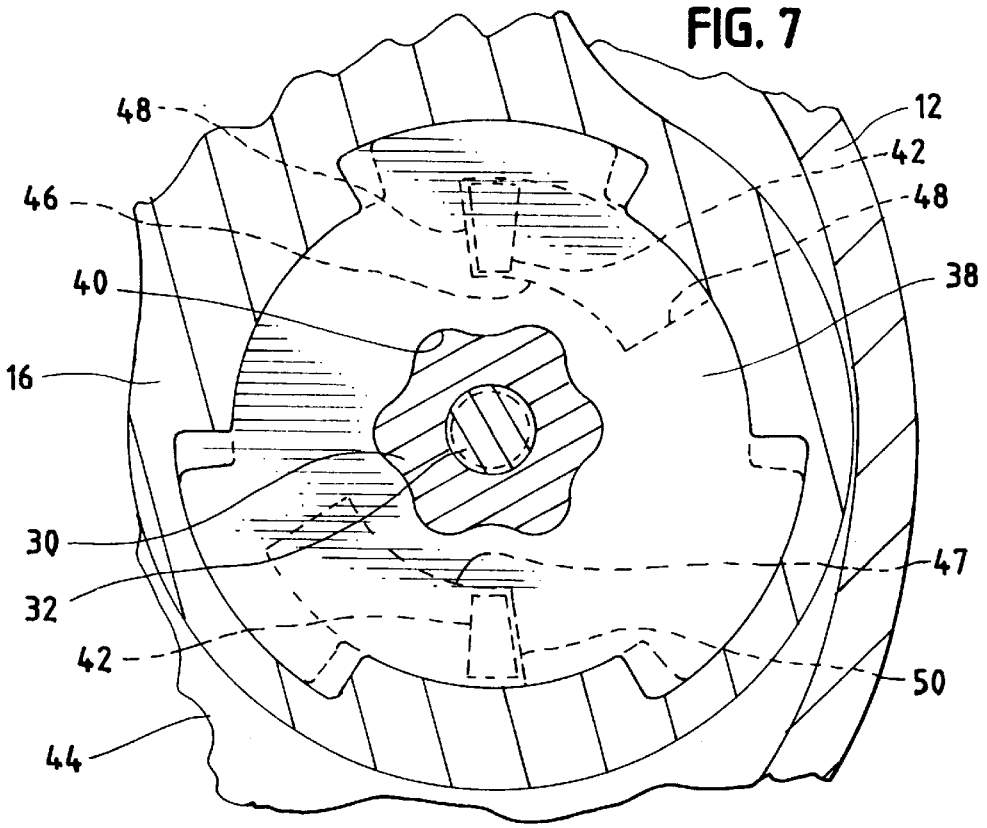
FIG. 7 is a cross-sectional view taken through line 7—7 of FIG. 6.

A preferred embodiment of the window lock actuator 10 of the present invention is shown in FIG. 1 with its housing 12 suitably secured to a casement window frame 14. (It should also be understood that the actuator 10 could be used with other window types, for example with awning windows in which case the actuator would be disposed along the bottom of the frame).

A control member 16 having a suitable handle 18 on one end is suitably secured to the housing 12 for pivoting about an axis 20. In particular, aligned housing openings 26*a,* 26*b* are axially oriented, and an actuator link 28 is secured to the housing 12 for pivoting about the axis 20 through use of those openings 26*a,* 26*b*. Specifically, the actuator link 28 includes an axially extending portion 30 having a non-cylindrical outer surface and extending through a cylindrical one of the housing openings 26*a*. The axially extending portion 30 of the actuator link 28 preferably has outermost surface areas which generally define a cylinder so that the axially extending portion 30 generally cooperates with the cylindrical housing opening 26*a* to further reliably ensure pivoting of the actuator link 28 about the axis 20. Still further, a securing member 32 (see FIGS. 2 and 6) such as a screw extending through a countersunk one of the housing openings 26*b* is received in a threaded hole 34 in the actuator link axially extending portion 30 to secure the link to the housing 12.

The actuator link 28 is on its end pivotably connected to a lock structure, as through a connecting lock link 34 (partially shown in phantom in FIG. 2) which is a part of a locking structure. For example, as is known in the art, the lock link 34 could be secured to a tie bar secured for substantially longitudinal motion along one side of the window frame 14. As is known in the art and shown, for example, in U.S. Pat. Nos. 4,991,886 and 5,045,265 and 5,118,145, the contents of which are hereby fully incorporated by reference, the actuator link 28 could be connected to a lock structure having a tie bar with one or more catches or rollers thereon engageable with corresponding cam members secured to the side of the window sash, whereby the rollers may be moved onto the ramps of the associate cam members for locking and then moved vertically off of the ramps for unlocking. It will thus be understood that the actuator link 28 may be pivoted to move the lock structure between locking and unlocking positions.

A pivot link 38 (such as a bushing) is disposed around the axially extending portion 30 of the actuator link 28, with the pivot link 38 having an opening 40 substantially matching the non-cylindrical surface of the link axially extending portion 30 so that the pivot link 38 will pivot with the actuator link 28 around the axis 20 while also being free to move axially relative to the link axially extending portion 30.

The pivot link 38 includes on one side a pair of stop members 42 extending axially therefrom. The housing 12 has on one side wall 44 a pair of stop openings 46, 47 which each have a stop surface 48, 50 at one end. The stop openings 46, 47 are radially spaced from the pivot axis 20 an amount substantially equal to the radial spacing of the stop members 42 from the pivot axis 20 so that at selected positions (essentially corresponding to the extreme pivot positions in which the actuator 10 places the lock structure in the locked or unlocked positions), the stop members 42 align with the stop openings 46, 47.

A suitable biasing structure is used to urge the pivot link axially toward the one side wall 44 of the housing 12. As shown in the figures, a leaf spring 54 may be disposed about the actuator link axially extending portion 30 and the other housing side wall 56 so as to constantly urge the pivot link 38 toward the one side wall 44 so that, when aligned, the pivot link stop members 42 will move into the stop openings 46, 47. In the preferred embodiment, the stop surfaces 48, 50 and the side walls of the stop members 42 are axially oriented so that, when engaged, they will prevent pivoting of the pivot link 38 and the actuator link 28 should any pivoting force be applied thereto.

The outer surface 60 of the pivot link 38 includes sloped or tapered cam surfaces 62 which cooperate with sloped or tapered cam surfaces 66 of the axial opening 68 of the control member 16. As discussed below, the cam surfaces 62, 66 cooperate so as to move the pivot link 38 axially when the control member 16 and pivot link 38 are pivoted relative to each other.

Operation of the actuator 10 is thus as follows.

The actuator 10 is shown in one of its extreme secured positions (with a connected lock structure either locked or unlocked) in FIG. 6, with the leaf spring 54 biasing the pivot link 38 so that the stop members 42 are in the stop openings 46, 47 in the one housing side wall 44. Should a potential intruder gain access between the window sash and frame so as to directly or indirectly (for example, through a connected lock component such as a tie bar) attempt to pivot the actuator link 28 as would be necessary to change the condition of the lock, he would be prevented from doing so by the engagement of the stop members 42 with the stop surfaces 48, 50 which prevent pivoting of the pivot link 38 and the connected actuator link 28.

If an authorized user were however to wish to change the position of the lock by pivoting the control member 16 from inside the dwelling, this can be easily accomplished. Specifically, initial pivoting of the control member 16 will effectively pivot the control member 16 relative to the pivot link 38, during which time the cooperation of the cam surfaces 62, 66 would move the pivot link 38 axially toward the other housing side wall 56 until such time as the pivot link 38 moved sufficiently to clear its stop members 42 from the stop openings 46, 47. Once that occurs, the pivot link 38 and attached actuator link 28 would then be free to pivot relative to the housing 12. Since, in the preferred embodiment, the control member 16 is substantially the same thickness as the width of the housing opening, at some point quickly after freeing the stop members 42 from the stop openings 46, 47, the pivot link 38 will essentially be moved over toward the other housing side wall 56 so that no further axial movement in that direction could occur, in which case no further relative pivotal movement between the control member 16 and the pivot link 38 could occur, in which case the cam surfaces 62, 66 will cooperate during further pivoting of the control member 16 to also pivot the pivot link 38 and actuator link 28.

Once the control member 16 has been completely pivoted to its other extreme position, the stop members 42 will be aligned with the other of the stop openings 47, 46 so that, when the control member 16 is released, the biasing force of the leaf spring 54 will again force the pivot link 38 toward the one housing side wall 44 (causing a slight relative pivoting of the control member 16 and pivot link 38 due to the cam surfaces 62, 64 as the pivot link 38 moves axially) to move the stop members into the other stop openings 47, 46.

Axial movement of the pivot link 38 at the end of travel during operation can provide a positive feel or feedback to the person operating the control member 16 to provide an indication that the control member 16 has been properly placed in a secure position.

In subsequent pivoting of the control member 16 back toward its opposite extreme position, those of the cam surfaces 62, 66 which engaged during control member 16 pivoting in the one direction will separate and oppositely oriented cam surfaces 62*a*, 66*a* will cooperate to cause axial biasing of the pivot link 38 during pivoting of the control member 16 in the other direction. Pivoting will then continue in the same manner as described above, with the cam surfaces 62*a*, 66*a* cooperating to free the pivot link 38 by disengaging the stop members 42 from the stop openings 46, 47 in the housing side wall 44 and thereafter cooperating to cause the pivot link 38 to pivot with the control member 16 when the pivot link 38 cannot move any further axially.

It should be appreciated that with a housing 12 recessed in the window frame 14 as in the preferred embodiment, the pivoting of the control member 16 between extreme positions will generally be less than 180 degrees. As a result, it is preferred to provide two extended stop openings 46, 47 in the housing wall 44, which openings are substantially larger than the stop members 42. The stop openings 46, 47 define stop surfaces 48, 50 at opposite ends, and it is those stop surfaces 48, 50 at the end of the openings 46, 47 which abut with the stop members 42 to limit pivoting of the pivot link 38 and actuator link 28. Therefore, it should be appreciated that it is the angular spacing of the adjacent stop surfaces 48, 50 which should generally conform to the expected amount of pivoting of the control member 16, and not the general spacing of the stop openings 46, 47 from each other.

Though the stop openings 46, 47 for convenience of manufacture are generally oriented at 180 degree spacing, four stop openings used with two stop members could instead be used. (Of course, other than two stop members could also be used within the scope of this invention.) If extended stop openings 46, 47 are used, it should be understood that the center portion of the stop openings 46, 47 may serve no purpose inasmuch as the stop members 42 will never be aligned there, but rather will only be aligned at the ends of the stop openings 46, 47. Thus, as indicated in FIG. 5, when the control member 16 is pivoted to its upper limit (with the actuator link 28 generally extending down), the stop members 42 will engage stop surfaces 48*a*, 50*a* to prevent pivoting back down to its other extreme position, and when the control member 16 is pivoted to its lower limit (with the actuator link 28 generally extending up), the stop members 42 will engage stop surfaces 48*b*, 50*b* to prevent pivoting back up.

The structure of the preferred embodiment of the present invention thus provides excellent security in that, at both ends of its operation, its position can be changed only by direct manipulation of the control member 16. Such operation is advantageous to permit the actuator 10 to be installed for operation with locking being accomplished through pivoting in either direction. This permits the structure to be used in a wide variety of windows, without requiring different "handed" structures for different operations, and further eliminates any risk of the actuator 10 being installed incorrectly so as to not provide the desired security feature in the locking position.

Further, even though security against intrusion is not to be expected if the window sash is open, the security against inadvertent changing from the open to the locked position is also highly desirable. For example, in typical installations in which the actuator 10 is in the open position with the control member 16 pivoted down and the lock components such as a tie bar and rollers raised, the weight of those components would bear down and bias the actuator link toward pivoting toward the locking position. By preventing such a biasing force from changing the actuator 10 to the locking position from the open position, the actuator 10 of the preferred embodiment of the present invention will prevent damage to the window sash, window operator, tie bar, and/or rollers as might occur should a person attempt to close the window sash with the rollers interfering with the cam members (as could occur if the actuator were to unknowingly change the rollers to their locking position). Similarly, this security will prevent a person from being misled into believing that the sash is not locked, even though perhaps closed against the frame, to allow a person to rely upon the window being open should they leave the building with an expectation of being able to gain access through the window or for some other reason relying upon the window being unlocked.

The above advantages are further provided by a structure having a minimum number of parts, thereby not only minimizing manufacturing and assembly time and cost but also maximizing reliability and product life. Further, this can all be accomplished with a structure which will accommodate the aesthetic needs of windows in today's markets, with minimal visual intrusion. Still further, this structure may be easily installed not only in new window structures, but also with existing window locking structures, as the actuator 10 may readily replace previously installed actuators. It should also be apparent that this actuator structure may be easily used by people of all ages.

Still other aspects, objects, and advantages of the present invention can be obtained from a study of the specification, the drawings, and the appended claims.

I claim:

1. An actuator for a window lock, comprising:

a drive member secured for pivoting about an axis;

a pivotable actuator link having a radial portion operatively connectable to a window lock for operating a lock in response to pivoting of the actuator link;

a pivot link substantially secured for pivoting with said actuator link and said drive member, said pivot link having a stop member which in a first position is secured against pivoting and in a second position freely pivots about said axis;

means for biasing said pivot link toward said first position; and means for biasing said pivot link toward said second position when a pivoting force is applied to said drive member.

2. The actuator of claim 1, wherein said pivot link moves axially between said first and second positions.

3. The actuator of claim 2, wherein said means for biasing said pivot link toward said second position comprises engaging sloped cam surfaces on said pivot link and said drive member.

4. The actuator of claim 2, further comprising a housing receiving said pivot link and one end of said drive member for pivoting about said axis between opposite sides of said housing, wherein said restraining means comprises a stop surface on one side of said housing and a stop surface on said pivot link, said stop surfaces axially overlapping when said pivot link is in said first position.

5. The actuator of claim 4, wherein said means for biasing said pivot link toward said first position biases said pivot link toward said one side of said housing.

6. The actuator of claim 4, wherein said housing opposite sides are spaced apart a distance less than the combined axial thicknesses of the pivot link and the one end of said drive member.

7. The actuator of claim 4, wherein said housing one side includes a recess with said housing stop surface comprising one side of said recess, and said pivot link stop surface is a side of a tab projecting outwardly from one side of said pivot link and into said housing recess when said pivot link is in said first position.

8. The actuator of claim 7, wherein said stop surfaces are substantially axially oriented.

9. The actuator of claim 1, wherein the pivot link is a bushing which is axially movable relative to the drive member.

10. The actuator of claim 9, wherein the bushing is axially movable relative to the actuator link.

11. The actuator of claim 9, wherein the bushing has an axially extending non-cylindrical central opening and an axially extending non-cylindrical outer surface, with said actuator link cooperating with one of said bushing central opening and outer surface to substantially secure said actuator link for pivoting with said bushing and said drive member cooperating with the other of said bushing central opening and outer surface to substantially secure said drive member for pivoting with said bushing.

12. The actuator of claim 11, wherein:

said bushing is received in an opening in the drive member, said bushing outer surface cooperating with said drive member opening to substantially pivot the bushing and the drive member together; and said actuator link includes an axial shaft received in the bushing central opening and cooperating with the bushing central opening to allow axial movement of the bushing relative to the actuator link while securing the actuator link and bushing for pivoting together about said axis.

13. An actuator for a window lock, comprising:

a drive member secured for pivoting about an axis;

a pivotable actuator link having a radial portion operatively connectable to a window lock for operating a lock in response to pivoting of the actuator link;

a bushing having an axially extending non-cylindrical central opening and an axially extending non-cylindrical outer surface, with said actuator link cooperating with one of said bushing central opening and outer surface to substantially secure said actuator link for pivoting with said bushing and said drive member cooperating with the other of said bushing central opening and outer surface to substantially secure said drive member for pivoting with said bushing while allowing said bushing to move axially relative to said drive member;

an axially extending stop member on said bushing; and a fixed stop member axially overlapping with said bushing stop member when said bushing is in a first axial position relative to said drive member to prevent pivoting of said drive member when pivoting forces are applied to said actuator link radial portion.

14. The actuator of claim 13, wherein:

said bushing is received in an opening in the drive member, said bushing outer surface cooperating with said drive member opening to substantially pivot the bushing and the drive member together; and said actuator link includes a non-cylindrical axial shaft received in the bushing central opening and cooperating with the bushing central opening to allow axial movement of the bushing relative to the actuator link while securing the actuator link and bushing for pivoting together about said axis.

15. The actuator of claim 14, further comprising a biasing member engaging said bushing to bias said bushing toward said first axial position.

16. The actuator of claim 15, further comprising means for biasing said bushing toward a second position in which said stop members are axially separated to allow pivoting of the bushing about said axis, said biasing means being operable only in response to pivoting of the drive member.

17. The actuator of claim 16, wherein said bushing biasing means comprises engaging sloped cam surfaces on said bushing and said drive member.

18. The actuator of claim 17, wherein the drive member is manually pivotable.

19. The actuator of claim 18, wherein the drive member is a handle pivotable through a path of between 90 degrees and 180 degrees.

20. An actuator for a lock, comprising:

a fixed member defining a pivot axis and having a stop surface at least in part extending axially and radially relative to the pivot axis;

a actuator link secured to said fixed member for pivoting about said pivot axis, said actuator link being operatively connectable to a window lock for operating a lock in response to pivoting of the actuator link;

a stop link secured for pivoting with said actuator link, said stop link being axially movable and including a stop member axially aligned with the fixed member stop surface in a securing position and axially spaced from the fixed member stop surface in an operating position;

means for axially biasing said stop link toward said securing position;

a drive member pivotable about said pivot axis; and means for drivably connecting said drive member for pivoting with said stop link, said drivably connecting means including means for biasing said stop link toward said operating position in response to a drive force applied to said drive member.

21. The actuator of claim 20, wherein said means for biasing said stop link toward said operating position comprises engaging sloped cam surfaces on said stop link and said drive member.

22. The actuator of claim 20, wherein said fixed member includes a recess with said fixed member stop surface comprising one side of said recess, and said stop link stop member projects outwardly from one side of said stop link and into said fixed member recess when said stop link is in said securing position.

23. The actuator of claim 22, wherein said fixed member stop surface is substantially aligned with a side of said stop link stop member when said stop link is in said securing position.

24. The actuator of claim 20, wherein said fixed member defines a housing fixable to a window frame and having an interior with the drive member and stop link pivotable in the interior, said stop surface being on one side of the housing interior.

25. The actuator of claim 24, wherein said means for axially biasing said stop link toward said securing position biases said stop link toward said one side of said housing.

26. The actuator of claim 24, wherein said housing interior has said one side and an opposite side, said one side and said opposite side being substantially parallel to each other and substantially perpendicular to said pivot axis, said housing one side and housing other side being spaced apart a distance less than the combined axial thicknesses of the stop link and the drive member in said housing interior.

27. The actuator of claim 20, wherein the stop link is a bushing which is axially movable relative to the drive member.

28. The actuator of claim 27, wherein the bushing has an axially extending non-cylindrical central opening and an axially extending non-cylindrical outer surface, with said actuator link cooperating with one of said bushing central opening and outer surface to substantially secure said actuator link for pivoting with said bushing and said drive member cooperating with the other of said bushing central opening and outer surface to substantially secure said drive member for pivoting with said bushing.

29. The actuator of claim 28, wherein:

said bushing is received in an opening in the drive member, said bushing outer surface cooperating with said drive member opening to substantially pivot the bushing and the drive member together; and said actuator link includes an axial shaft received in the bushing central opening and cooperating with the bushing central opening to allow axial movement of the bushing relative to the actuator link while securing the actuator link and bushing for pivoting together about said axis.

30. The actuator of claim 20, wherein the drive member is manually pivotable.

31. The actuator of claim 30, wherein the drive member is a handle pivotable through a path of between 90 degrees and 180 degrees.

32. An actuator for a window lock, comprising:

a housing mountable to a window frame and defining an opening between opposite sides, one of said sides having a recessed portion therein;

a handle pivotable about an axis within said housing opening, said handle having a central opening with sloped cam surfaces therearound;

a cam bushing receivable in said handle central opening and having sloped cam surfaces engageable with said handle cam surfaces whereby pivoting of said handle relative to said cam bushing axially moves said cam bushing relative to said handle, and a stop tab extending from one side of said cam bushing and receivable in said housing recessed portion when said actuator is in a locking position;

means for axially biasing said cam bushing one side toward said housing one side; and a actuator link operatively connectable to a window lock for operating a lock in response to pivoting of the actuator link, said actuator link further being pivotally connected to said cam bushing.

33. The actuator of claim 32, wherein the cam bushing has an axially extending non-cylindrical central opening and an axially extending non-cylindrical outer surface, with said actuator link cooperating with one of said bushing central opening and outer surface to substantially secure said actuator link for pivoting with said cam bushing and said drive member cooperating with the other of said cam bushing central opening and outer surface to substantially secure said drive member for pivoting with said cam bushing.

34. The actuator of claim 33, wherein:

said handle includes an axial opening with said handle sloped cam surfaces in said opening;

said cam bushing is received in said handle opening with the cam bushing sloped cam surfaces on said bushing outer surface, said bushing outer surface cooperating with said drive member opening to bias said cam bushing away from said housing one side in response to a pivoting force applied to said handle, and substantially pivot the cam bushing and the drive member together when said cam bushing is positioned with its stop tab out of said housing recessed portion; and said actuator link includes an axial shaft received in the cam bushing central opening and cooperating with the cam bushing central opening to allow axial movement of the bushing relative to the actuator link while securing the actuator link and cam bushing for pivoting together about said axis.

35. The actuator of claim 32, wherein the handle is pivotable through a path of between 90 degrees and 180 degrees.

* * * * *